US005668560A

United States Patent [19]

Evans et al.

[11] Patent Number: 5,668,560

[45] Date of Patent: Sep. 16, 1997

[54] WIRELESS ELECTRONIC MODULE

[75] Inventors: James Gifford Evans, Colts Neck; Martin Victor Schneider, Holmdel; Cuong Tran, Howell, all of N.J.

[73] Assignee: NCR Corporation, Dayton, Ohio

[21] Appl. No.: 380,277

[22] Filed: Jan. 30, 1995

[51] Int. Cl.[6] ..... H01Q 1/24

[52] U.S. Cl. ..... 343/702; 343/846; 343/828; 343/826

[58] Field of Search ..... 343/702, 700 MS, 343/841, 846, 828, 825, 826, 850, 853, 857; 455/344, 140, 156

[56] References Cited

U.S. PATENT DOCUMENTS 5,048,118 9/1991 Brooks et al. ..... 343/702
5,365,246 11/1994 Rasinger et al. ..... 343/702
5,376,943 12/1994 Blunden et al. ..... 343/702
5,408,699 4/1995 Yamashita et al. ..... 343/702
5,420,599 5/1995 Erkocevic ..... 343/702

*Primary Examiner*—Hoanganh T. Le
*Attorney, Agent, or Firm*—John A. Caccuro; Kerry H. Owens

[57] ABSTRACT

A wireless electronic module includes a folded monopole antenna having an antenna port impedance which is reactive at the RF frequency of operation and which conjugately matches the reactive impedance of the electronic circuit which connects to the antenna port. A grounded shield is interposed between the antenna and the electronic circuit to reduce RF losses at the antenna.

13 Claims, 4 Drawing Sheets

WIRELESS ELECTRONIC MODULE

TECHNICAL FIELD

This invention relates to wireless electronic modules and, more particularly, to an efficient way of coupling an antenna to the electronic module.

BACKGROUND OF THE INVENTION

Low-cost antenna/detector modules are a key component in passive microwave links, low-data-rate local area networks (LANs), and wireless electronic shelf labels used in the wireless supermarket. The architecture of these systems is typically based on modulated backscattering, which is simply a short-range digital radio link transmitting data by means of a modulated scatterer. One type of antenna used in such systems is the L-shaped inverted-F radiator (LIFA antenna) designed for use in a wireless LAN modem, as described in the article written by N. Erkocevic in the publication entitled "Antenna For Wireless LAN Modem," *IEEE First Symposium on Communications and Vehicular Technology in the Benelux*, Oct. 27–28, 1991, Delft, The Netherlands. There is a continuing need to improve the design of the antenna and associated circuit to further enhance the sensitivity and bandwidth of such systems.

SUMMARY OF THE INVENTION

In accordance with the present invention, a wireless electronic module, arranged to operate at a predetermined frequency, comprises a folded monopole antenna which is folded around a corner of the electronic module and which has a reactive antenna port impedance at the predetermined frequency and an electronic circuit which is connected to the antenna port and which has an impedance conjugately matching the antenna port impedance at the predetermined frequency. In one embodiment, the antenna is a quarter-wave, the antenna port impedance is inductive, and the electronic circuit impedance is capacitive at the predetermined frequency. According to another aspect of the invention, a grounded shield is placed between a radiating portion of the antenna and the electronic circuit. The grounded shield has a length which is parallel to and extends beyond a radiating end of the antenna to form a short, uniform transmission line with the radiating end.

DETAILED DESCRIPTION

The drawings of the various figures are not necessarily to scale and contain dimensional relationships which are exaggerated to aid in the clarity of the description. In the following description, elements of each figure have reference designations associated therewith, the most significant digit of which refers to the figure in which that element is first referenced and described (e.g., 101 is first referenced in FIG. 1).

Figure 1:
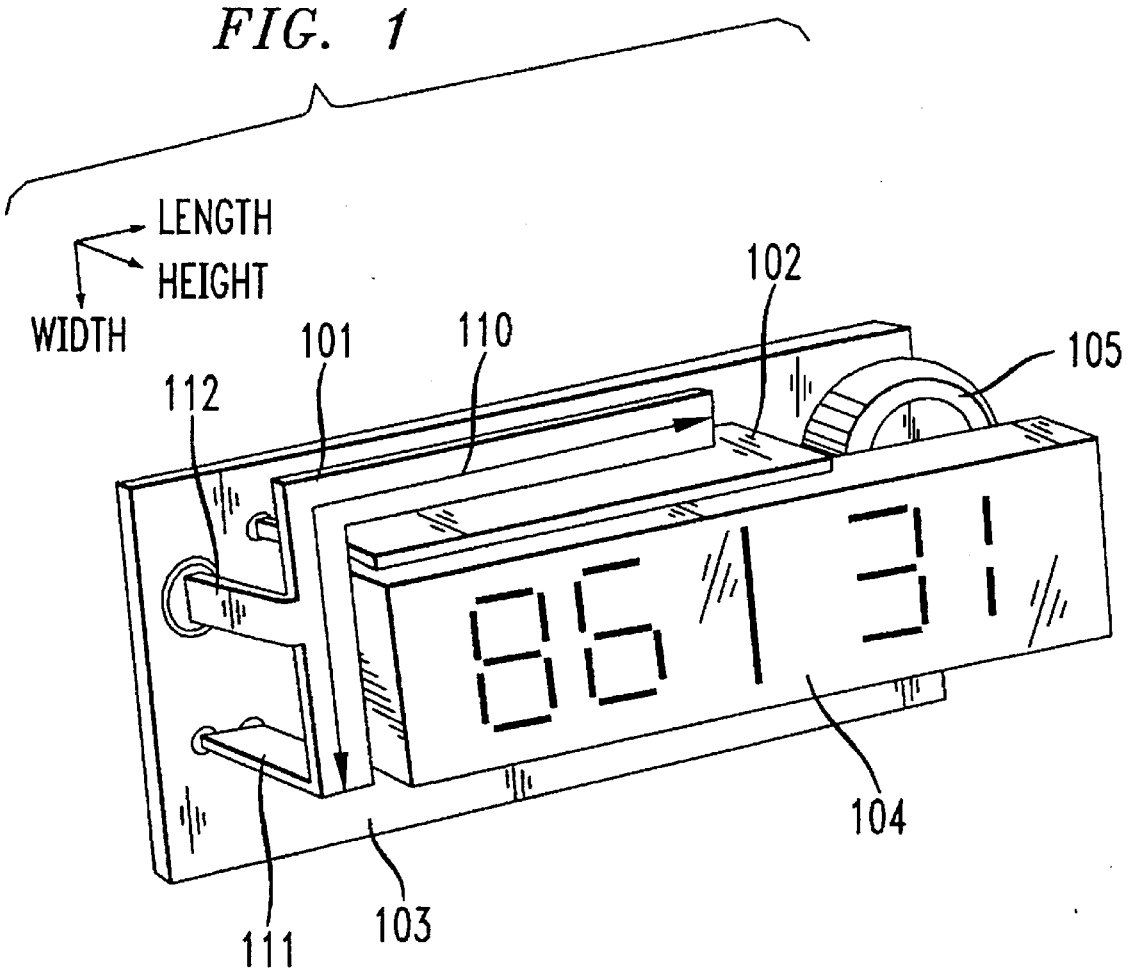
FIG. 1 shows a perspective view of a wireless electronic module incorporating the present invention.

Shown in FIG. 1 is a perspective view of a wireless electronic module 100 implemented as an electronic shelf label. The module includes a quarter-wave folded monopole inverted-F antenna 101, a grounded shield 102, a metal ground plane 103, a liquid crystal display (LCD) 104, and a battery 105. Other circuit components of the module are hidden from view by LCD 104. As shown, the folded monopole antenna 101 is "wrapped around" one corner of the electronic module 100 to achieve a compact module design that can be inserted into a small plastic casing for use, for example, as a wireless Electronic Shelf Label (ESL). The folding of the monopole antenna 101 and "wrapping" it around one corner of the electronic module 100 enables the module to accomodate a $\lambda/4$ monopole antenna. The antenna may range from ⅛ to ¼ wavelength.

The shape of the folded monopole antenna is similar to the previously referenced Erkocevic antenna. The Erkocevic LIFA antenna is designed so that its port impedance is resistive (approximately 50 ohms) at its frequency of operation. In comparison, the folded monopole antenna 101 of the present invention is designed to have a port impedance that is inductive to conjugately match the capacitive impedance of a detector utilized in the electronic module. Additionally, the present invention utilizes the grounded metal shield 102 mounted between the folded monopole antenna 101 and LCD display 104 to shield the folded monopole antenna 101 from adjacent circuit components, such as the LCD 104, to reduce high RF losses at antenna 101.

The LCD 104 has high RF losses caused by the liquid crystal matrix, the polyimide alignment layers, the glass layers, and control electrodes. These losses reduce the RF efficiency of antenna 101 which is in close proximity to LCD 104. In accordance with the present invention, RF efficiency is maintained by interposing the grounded shield 102 between the radiating end of antenna 101 and LCD 104 and other circuits of electronic module 100. The grounded shield 102 has a length which is at least as long as the radiating end of antenna 101. The shield 102 is mounted so that its length extends in parallel to and beyond the radiating end of antenna 101 and shield 102 has a height that extends above the height of antenna 101. The grounded shield 102 in parallel with the radiating end of antenna 101 forms a short, uniform transmission line. The grounded metal shield 102 shields the open or radiating end of antenna 101 electrically from LCD 104. Due to dimensions and positioning of grounded metal shield 102, electromagnetic radiation from antenna 101 terminates on shield 102. Consequently, the LCD 104 is electromagnetically decoupled from antenna 101 and the efficiency of antenna 101 is not reduced by the lossy material of LCD 104.

Figure 2:
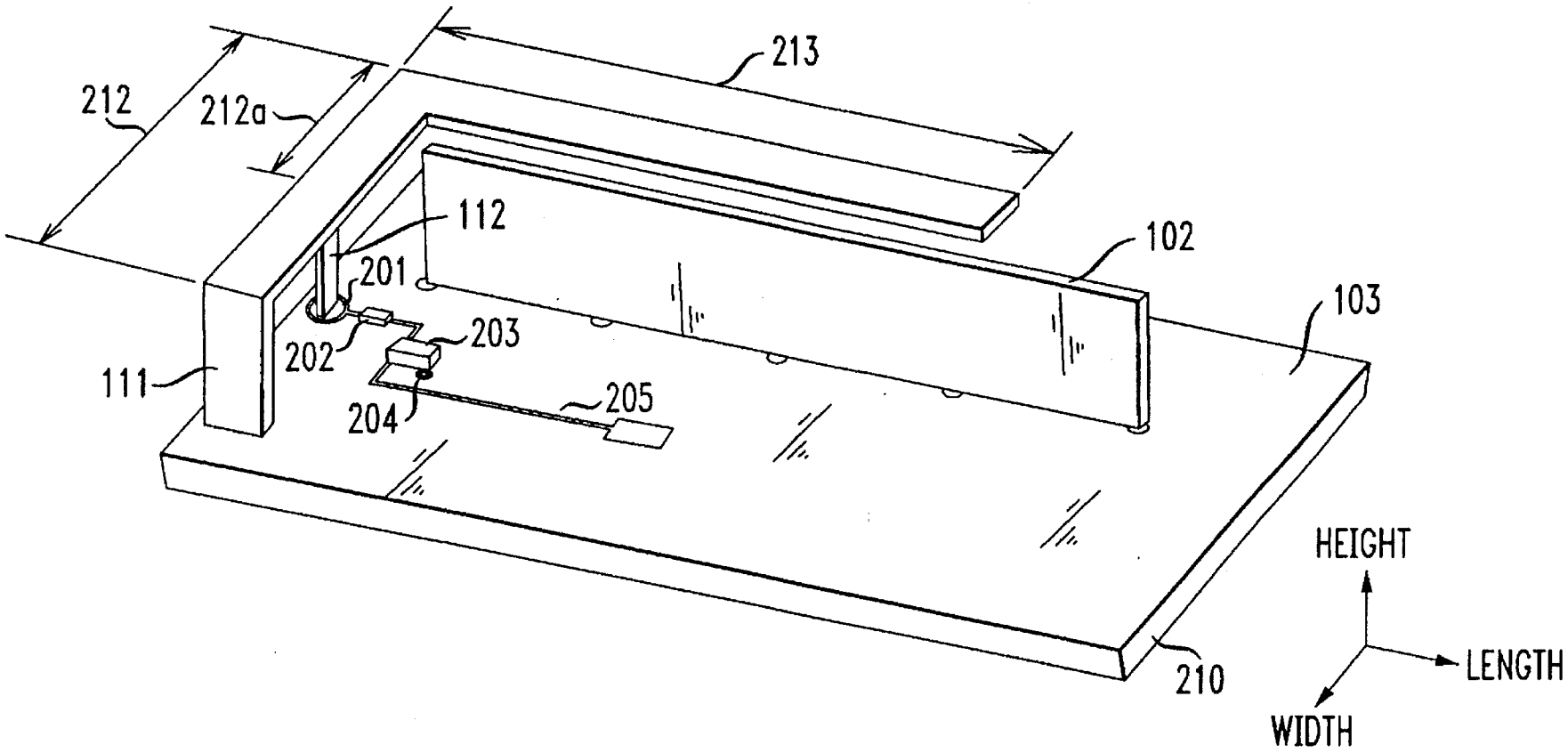
FIG. 2 is a perspective view illustrating details of the folded monopole inverted-F antenna, ground shield and ground plane of the module.

With reference to FIG. 2, the details of the design of antenna 101 and ground shield 102 is described. The antenna 101 consists of a unitary L-shaped microstrip conductor 110 having two support legs or strips 111 and 112, thereby forming the folded monopole inverted-F antenna. These support strips 111 and 112 maintain the antenna 101 a predetermined height above ground plane 103. The first support strip 111 is electrically connected or shorted to ground plane 103 which is formed by a deposited metal surface on the top and bottom of printed circuit board 210. The second strip 112 is isolated from ground plane 103 by a thin dielectric material which is deposited over the ground plane 103. The dielectric material may be, illustratively, FR-4, a low-cost circuit board material. The bottom part 201 of the second strip 112 forms an antenna port 201 for antenna 101, which means that a signal incident on antenna 101 generates an RF voltage between the bottom of the second strip 112 (antenna port 201) and the ground plane 103. This RF voltage is resonated and detected by a Schottky diode 202 of the module 100 and the output appears on lead 205.

The antenna has a total length (110) of about $3\lambda_0/8$ which is about 5.0 cm at an operating frequency of 2.45 GHz. The height (211) of the support strips 111 and 112 is about 0.8 cm. The antenna 101 illustratively may be fabricated from a stainless steel sheet by cutting an essentially L-shaped geometry (formed by segments 213 and 211, 212, in addition to the second strip 112 extending perpendicularly to 211) using a well-known computer-controlled wire Electron Discharge Machining (wire EDM). The resulting L-shaped metal piece is then appropriately bent to obtain the inverted-F shape of antenna 101 shown in FIG. 2.

The radiation characteristic of antenna 101 (not shown) produces electric field components $E_\theta$ and $E_\phi$ which are nearly isotropic.

In operation, a modulated RF voltage received by antenna 101 is detected or demodulated by diode 202 to obtain an audio or video signal which is then further amplified and processed by electronic module 100 as will be described in a later paragraph. The detector diode 202 is selected to achieve a good frequency response in the detecting and reflecting of RF signals. In a preferred embodiment of the present invention, diode 202 is a Schottky barrier-type silicon diode.

The sensitivity of electronic module 100 is optimized if the port 201 impedance of antenna 101 is conjugately matched to the impedance of Schottky diode 202. Since the diode 202 impedance is mainly determined by the capacitance of its junction, the antenna 101 impedance must be close to the conjugate of the junction reactance at the desired RF frequency of operation of electronic module 100. Consequently, the impedance at antenna port 201 at the operating frequency 2.45 GHz of electronic module 100 is inductive. More generally, the antenna port 201 may be positioned along antenna 101 so that at the desired RF frequency of operation it conjugately matches the input reactance of the module 100. If the antenna 101 is made $\lambda/2$ in length and the input impedance of module 100 is inductive, then, if desired, a position can be found so that the antenna port 201 impedance will be capacitive at the desired RF frequency of operation. Consequently, using different antenna lengths, port positions and frequency of operation, a variety of conjugately matching antenna port 201 impedances may be obtained.

Figure 3:
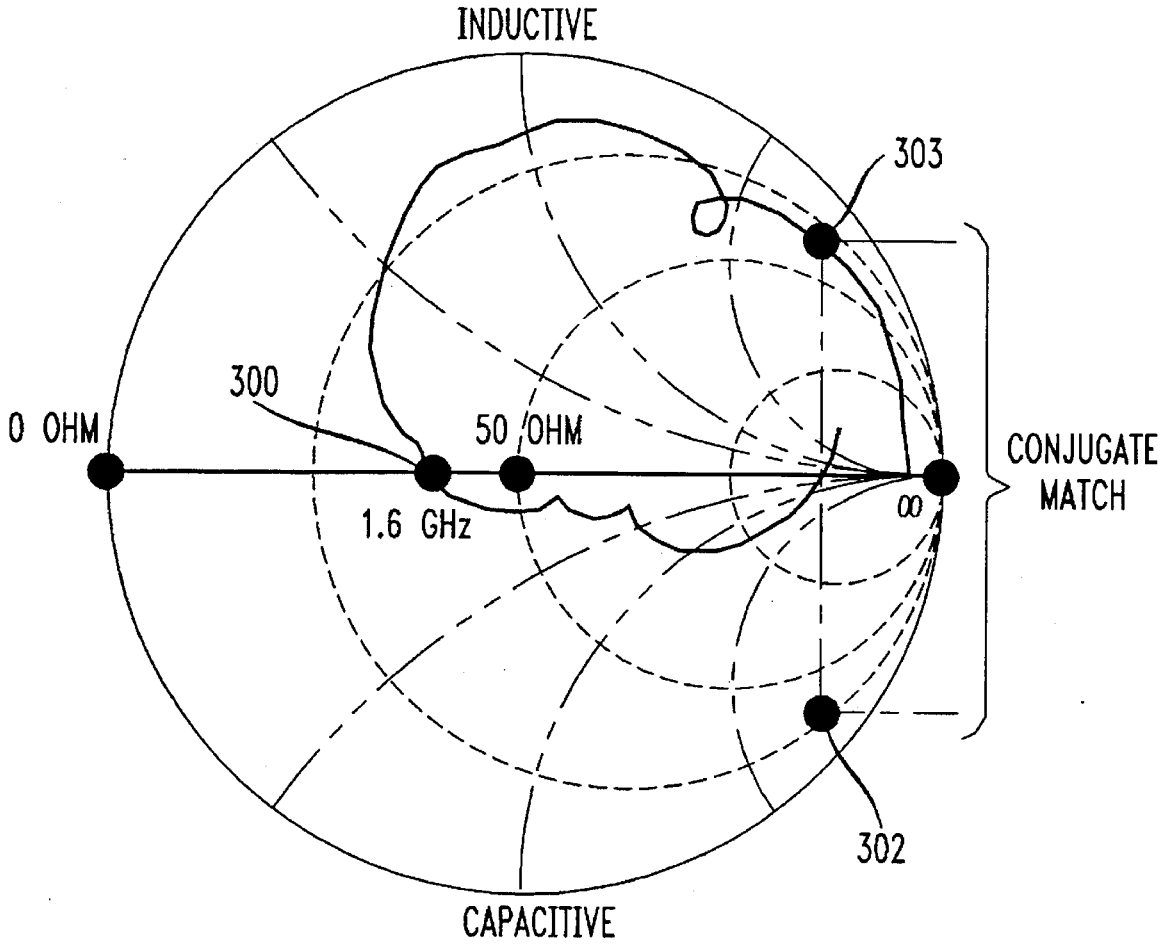
FIG. 3 shows an illustrative Smith chart plot of the impedance of the antenna at various frequencies.

With reference to FIG. 3, we show an illustrative Smith chart plot of the impedance of antenna 101 at a frequency range extending from 1.4 to 2.6 GHz. The diode 202 impedance is indicated by 302 on the Smith chart of FIG. 3. At the desired frequency of 2.45 GHz, the antenna port 201 impedance, identified by 303 on FIG. 3, is inductive and conjugately matches the diode 202 impedance, shown as 302 on FIG. 3. The diode 202 and the antenna port 201 impedance are matched, resulting in a series resonant circuit. The resonance of the antenna alone occurs at a much lower frequency of 1.6 GHz, as shown by 304 of FIG. 3. At this frequency, the port impedance is purely resistive and close to 50 ohms.

Figure 4:
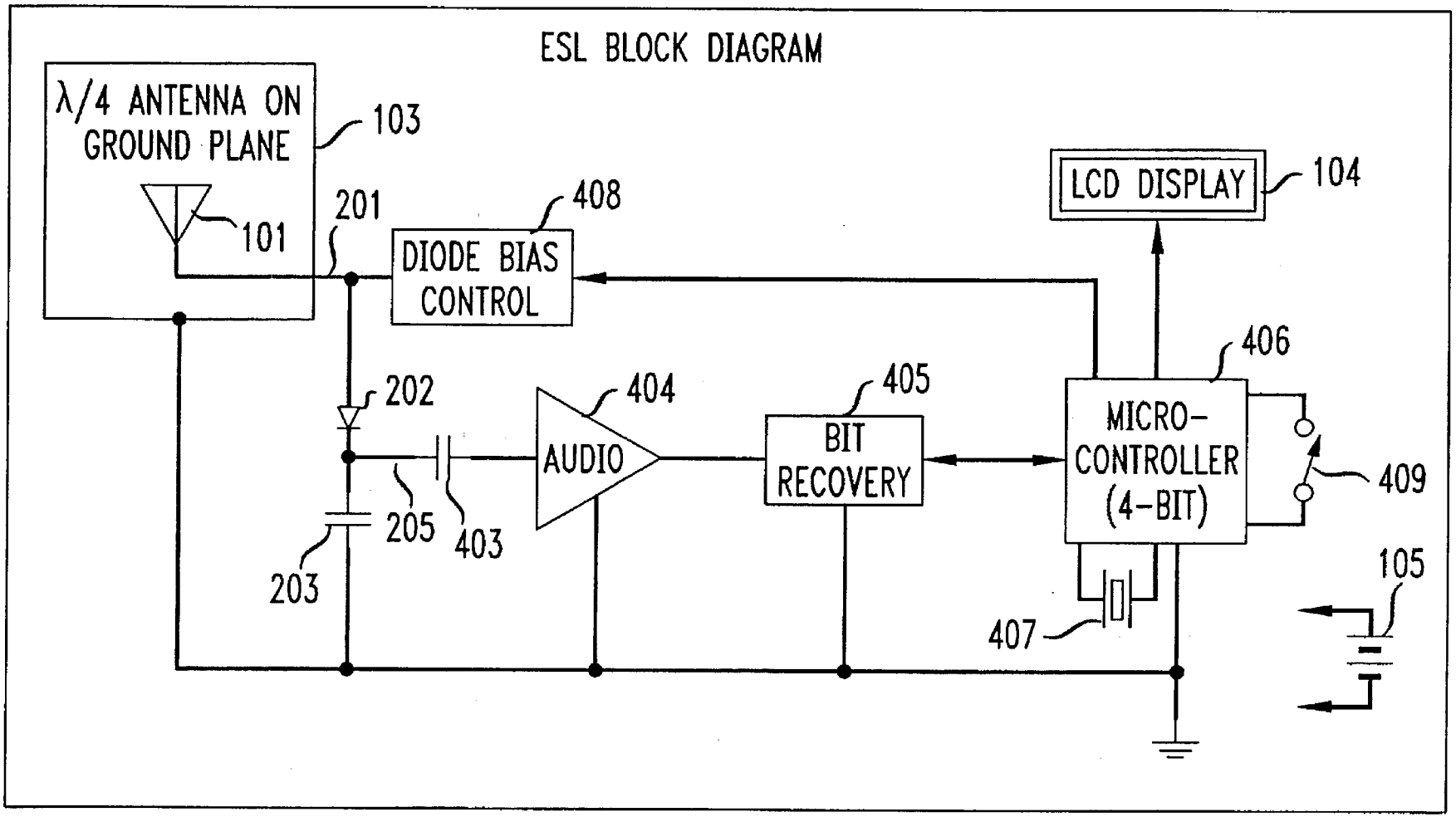
FIG. 4 is a block diagram of a wireless electronic module illustratively implemented as an Electronic Shelf Label (ESL).

With reference to FIG. 4, we describe one type of electronic module, illustratively an Electronic Shelf Label (ESL) which is implemented using the present invention. The ESL acts like a "crystal radio" to receive an on/off keyed amplitude modulated downlink signal. The modulated RF downlink signal is received by antenna 101 located on ground plane 103. The antenna port 201 connects in series with diode 202 and capacitor 203. The diode bias control circuit 408 connects to the junction of antenna port 201 and the anode of diode 202. Because of the series resonance of antenna 101 and diode 202, all of the detected RF signal (low frequency audio signal) appears across capacitor 203. The coupling capacitor 403 connects to the cathode of diode 202 and couples the resulting audio signal to audio amplifier 404. The output of audio amplifier 404 is processed by bit recovery circuit 405 which detects on/off keyed data bits in the audio signal. Microcontroller 406 processes the data bits from bit recovery circuit 405 to generate data for display by LDC 104. Microcontroller 406 also controls diode bias circuit 408 which controls a bias current that flows through diode 202. A crystal oscillator 407 is used by microcontroller 406 to generate clock signals. A push-switch 409 provides a test for electronic module 100. The battery 105 provides power to electronic module 100.

When the diode bias current is set at a low level, a high RF impedance is presented to antenna 101 by diode 202. When the diode bias current is set at a high level, diode 202 presents a low RF impedance to the antenna 101. This changing of the impedance of diode 202 enables antenna 101 to change the phase of signals reflected therefrom. This enables the generation of acknowledgement signals from module 100 without the need of a transmitter circuit. When the diode bias current is set for optimum detection for diode 202, an RF impedance match exists between antenna 101 and diode 202 at 2.45 GHz and the input RF signal is detected and the resulting signal appears across capacitor 203.

What has been described is merely illustrative of the application of the principles of the present invention. While the invention has been described for use with an ESL device utilizing amplitude modulation, other types of modulation may be utilized. Moreover, the RF signal may be modulated using video, data or other types of signals. Other types of circuits, other than diode 202, are contemplated as being connectable to antenna 101 to implement a variety of wireless electronic modules. Other arrangements and methods can be implemented by those skilled in the art without departing from the spirit and scope of the present invention.

We claim:

1. A wireless electronic module arranged to operate at a predetermined radio frequency, comprising:

a folded monopole antenna having a grounded end connected to a ground plane and an open end, wherein the folded monopole antenna is folded around a corner of the electronic module and is connected to a support strip isolated from the ground plane, the support strip forming an antenna port having a reactive antenna port impedance at the predetermined frequency; and an electronic circuit connected to the antenna port, wherein the antenna port is positioned along the monopole antenna such that the electronic circuit has an impedance conjugately matching the reactive antenna port impedance at the predetermined frequency.

2. The module of claim 1 wherein the antenna is one-eighth to a quarter-wave long, the antenna port impedance is inductive, and the impedance of the electronic circuit is capacitive at the predetermined frequency.

3. The module of claim 2 wherein the electronic circuit includes a semiconductor device having a capacitive impedance conjugately matching the inductive antenna port impedance.

4. The module of claim 3 wherein the semiconductor device is a diode detector.

5. The module of claim 4 wherein the diode detector is a Schottky diode.

6. The module of claim 3 wherein the semiconductor device is a detector and wherein the electronic circuit further includes a display for displaying information detected by the detector.

7. The module of claim 6 wherein the display is mounted adjacent to a grounded shield so that dielectric losses of display do not reduce the efficiency of the antenna.

8. The module of claim 6 wherein the display is a liquid crystal display.

9. The module of claim 1 further comprising a grounded shield placed between a radiating portion of the antenna and the electronic circuit.

10. The module of claim 3 wherein the grounded shield has a length which is parallel to a radiating end of the antenna and forms a short, uniform transmission line with the radiating end.

11. The module of claim 10 wherein the grounded shield extends beyond the radiating end of the antenna.

12. The module of claim 10 wherein the grounded shield extends above the height of the antenna.

13. The module of claim 1 wherein the folded monopole antenna has an inverted-F shape.

* * * * *